US008393399B2

(12) United States Patent
Judge

(10) Patent No.: US 8,393,399 B2
(45) Date of Patent: Mar. 12, 2013

(54) BLOWOUT PREVENTER WITH INTERVENTION, WORKOVER CONTROL SYSTEM FUNCTIONALITY AND METHOD

(75) Inventor: Robert Arnold Judge, Houston, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 0 days.

(21) Appl. No.: 12/956,205

(22) Filed: Nov. 30, 2010

(65) Prior Publication Data

US 2012/0132436 A1 May 31, 2012

(51) Int. Cl.
*E21B 7/12* (2006.01)

(52) U.S. Cl. ..... 166/366; 166/344; 166/351; 166/363

(58) Field of Classification Search ..... 166/366, 166/344, 351, 363, 364, 368; 251/1.1
See application file for complete search history.

(56) References Cited

U.S. PATENT DOCUMENTS

| | | | | |
|---|---|---|---|---|
| 3,894,560 | A * | 7/1975 | Baugh | 137/606 |
| 6,422,315 | B1 * | 7/2002 | Dean | 166/339 |
| 7,261,162 | B2 * | 8/2007 | Deans et al. | 166/336 |
| 7,690,433 | B2 * | 4/2010 | Reynolds | 166/338 |
| 2006/0201682 | A1 * | 9/2006 | Reynolds | 166/368 |
| 2009/0294129 | A1 * | 12/2009 | Judge et al. | 166/341 |
| 2009/0294130 | A1 * | 12/2009 | Rodriguez | 166/341 |
| 2010/0025044 | A1 | 2/2010 | McKay et al. | |

* cited by examiner

*Primary Examiner* — Thomas Beach
*Assistant Examiner* — Aaron Lembo
(74) *Attorney, Agent, or Firm* — Bracewell & Giuliani LLP

(57) ABSTRACT

System and method for controlling a blowout preventer (BOP) stack and a tree attached to a wellhead of a well. The system includes at least a MUX pod configured to receive electrical signals and a fluid under pressure, and to provide a first set of functions to the LMRP part, and a second set of functions to a lower BOP part; a pod extension module configured to receive the fluid under pressure from the MUX pod, and to provide a third set of functions to the tree based on the received fluid under pressure; and a control part configured to be attached to the tree and to communicate with the pod extension module. The third set of functions for the tree is different from the second set of functions provided to the lower BOP part.

21 Claims, 9 Drawing Sheets

BLOWOUT PREVENTER WITH INTERVENTION, WORKOVER CONTROL SYSTEM FUNCTIONALITY AND METHOD

BACKGROUND

1. Technical Field

Embodiments of the subject matter disclosed herein generally relate to methods and systems and, more particularly, to mechanisms and techniques for controlling a subsea tree with controls provided on a blowout preventer stack.

2. Discussion of the Background

During the past years, with the increase in price of fossil fuels, the interest in developing new production fields has dramatically increased. However, the availability of land-based production fields is limited. Thus, the industry has now extended drilling to offshore locations, which appear to hold a vast amount of fossil fuel.

Conventionally, wells in oil and gas fields are built up by establishing a wellhead housing, and with a drilling blowout preventer (BOP) stack installed on top of the wellhead, drilling down to produce the well hole while successively installing casing strings. When the drilling is finished, the well needs to be converted for production. For converting the cased well for production, a tubing string is run in through the BOP and a hanger at its upper end landed in the wellhead. Thereafter the drilling BOP stack is removed and replaced by a Christmas tree having one or more production bores containing actuated valves and extending vertically to respective lateral production fluid outlet ports in the wall of the Christmas tree.

This arrangement has involved problems which have, previously, been accepted as inevitable. Thus, some operations down hole have been limited to tooling which can pass through the production bore unless the Christmas tree is first removed and replaced by a BOP stack. However, this involves setting plugs or valves, which may be unreliable. The well is in a vulnerable condition whilst the Christmas tree and BOP stack are being exchanged and neither one is in position, which is a lengthy operation. Also, if it is necessary to pull the completion, consisting essentially of the tubing string on its hanger, the Christmas tree must first be removed and replaced by a BOP stack. This usually involves plugging and/or killing the well.

Another difficulty that exists in the subsea wells, relates to providing the proper angular alignment between the various functions, such as fluid flow bores, and electrical and hydraulic lines, when the wellhead equipment, including the tubing hanger, Christmas tree, BOP stack and emergency disconnect devices are stacked up. Because there are many different designs and manufacturers for trees and BOPs, ensuring proper alignment of the functions cannot practically be achieved.

FIG. 1 (which corresponds to FIG. 2A of U.S. Patent Application Publication no. US 2010/0025044 A1, the entire content of which is incorporated herein by reference) shows a conventional BOP stack 10 provided on top of a wellhead 12. A subsea tree 14 is provided between the stack 10 and the wellhead 12. Subsea tree 14 has a port 15 for receiving hydraulic and other signals. The wellhead 12 is attached to the ocean floor 16. Various rams 10*a-e* are provided in the stack 10 for sealing the well when necessary. A connector 18 is configured to connect the stack 10 to the tree 14. The configuration illustrated in FIG. 1 may be used when work need to be performed inside the well. It is noted that in this configuration no control is provided to tree 14 as the port 15 is not connected to any control system. Also, it is noted that currently the BOPs are not functionally connected to the tree.

As discussed above, when the well is in production, the BOP stack 10 is removed. However, if further work needs to be performed on the well, the BOP stack 10 has to be brought back, which makes the production well not operational for an extended amount of time.

An alternative to using the BOP stack for doing workover is the usage of an Installation WorkOver Control System (IWOC) which is illustrated in FIG. 2 (which corresponds to FIG. 2B of U.S. Patent Application Publication no. US 2010/0025044 A1). FIG. 2B shows the IWOC 19 including an electrical-hydraulic control of tree functions, lower marine riser package (LMRP) 20, emergency disconnect package (EDP) 22, etc. The IWOC is controlled by an IWOC umbilical 26 that communicates with a vessel or rig at the surface. Hydraulic lines 28 and 30 communicate with the IWOC umbilical 26 and provide hydraulic pressure to the tree 14 (via port 15) and to a hydraulic control unit 32. The IWOC umbilical 26 also provides electrical communication to a port 34.

However, for using the IWOC alternative, the operator of the well needs either to rent the IWOC equipment (which today costs in the millions of dollars range) or to own the IWOC equipment (which today costs in the tens of millions of dollars range). These high costs associated with the IWOC equipment are undesirable for the operator of the well. Additionally, many times the IWOC system must be integrated into a BOP systems's LMRP, which entails a great deal of modifications to the BOP when installing and removing. These operations add considerable expense for the operator. Accordingly, it would be desirable to provide systems and methods that are better than the background art.

SUMMARY

According to one exemplary embodiment, there is a blowout preventer (BOP) stack configured to provide Intervention WorkOver Control System (IWOC) functionality to a tree attached to a wellhead of a well. The BOP stack includes a lower marine riser package (LMRP) part configured to be attached to an end of a marine riser; a lower BOP part configured to be detachably attached to the LMRP part; a pod extension module attached to the LMRP part or the lower BOP part and configured to receive a fluid under pressure and provide a set of functions to the tree based on the fluid under pressure; and at least a MUX pod attached to the LMRP part or the lower BOP part and configured to receive electrical signals and the fluid under pressure and to transmit required electrical signals to the pod extension module. The set of functions for the tree are different from functions provided to the lower BOP part.

According to another exemplary embodiment, there is a system for controlling a blowout preventer (BOP) stack and a tree attached to a wellhead of a well, the BOP stack including a lower BOP part and a lower marine riser package (LMRP) part. The system includes at least a MUX pod configured to be attached to the LMRP part or the lower BOP part, to receive electrical signals and a fluid under pressure, and to provide a first set of functions to the LMRP part, and a second set of functions to the lower BOP part; a pod extension module configured to be attached to the lower BOP part or the LMRP part, to receive the fluid under pressure from the MUX pod, and to provide a third set of functions to the tree based on the received fluid under pressure; and a control part configured to be attached to the tree and to communicate with the pod extension module. The third set of functions for the tree is different from the second set of functions provided to the lower BOP part.

According to still another exemplary embodiment, there is a method for providing tree control via a lower blowout preventer (BOP) part, wherein the lower BOP part is connected to a lower marine riser package (LMRP) part to form a BOP stack that is attached undersea to the tree. The method includes attaching a pod extension module to the lower BOP part or the LMRP part; hydraulically connecting the pod extension module to a hydraulic supply system; electrically connecting the pod extension module to a MUX pod; attaching a hydraulic connector to the pod extension module, the hydraulic connector being configured to mate with a corresponding connection of the tree; and configuring the pod extension module to provide a set of functions to the tree and to transmit a fluid under pressure from the MUX pod to the tree.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of a BOP stack and IWOC systems. However, the embodiments to be discussed next are not limited to these systems, but may be applied to other systems that require to be supplied to with hydraulic pressure and/or electrical signals.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an exemplary embodiment, a BOP stack and a tree are configured to exchange electrical signals and/or hydraulic functions without the need of a dedicated IWOC system. In other words, existing BOP stacks and/or trees may be retrofitted with appropriated interfaces and/or junction plates and/or pod extension modules for allowing a direct communication (electrical and/or hydraulic) between these two pieces of equipment and for supplying the functionality offered by the dedicated IWOC systems. According to still another exemplary embodiment, a MUX pod may be configured to have an interface that directly communicates with the tree for controlling the tree. According to another exemplary embodiment, new BOP stacks and trees may be directly manufactured to have the capability to communicate with each other and thus, to provide the IWOC functionality.

Figure 3:
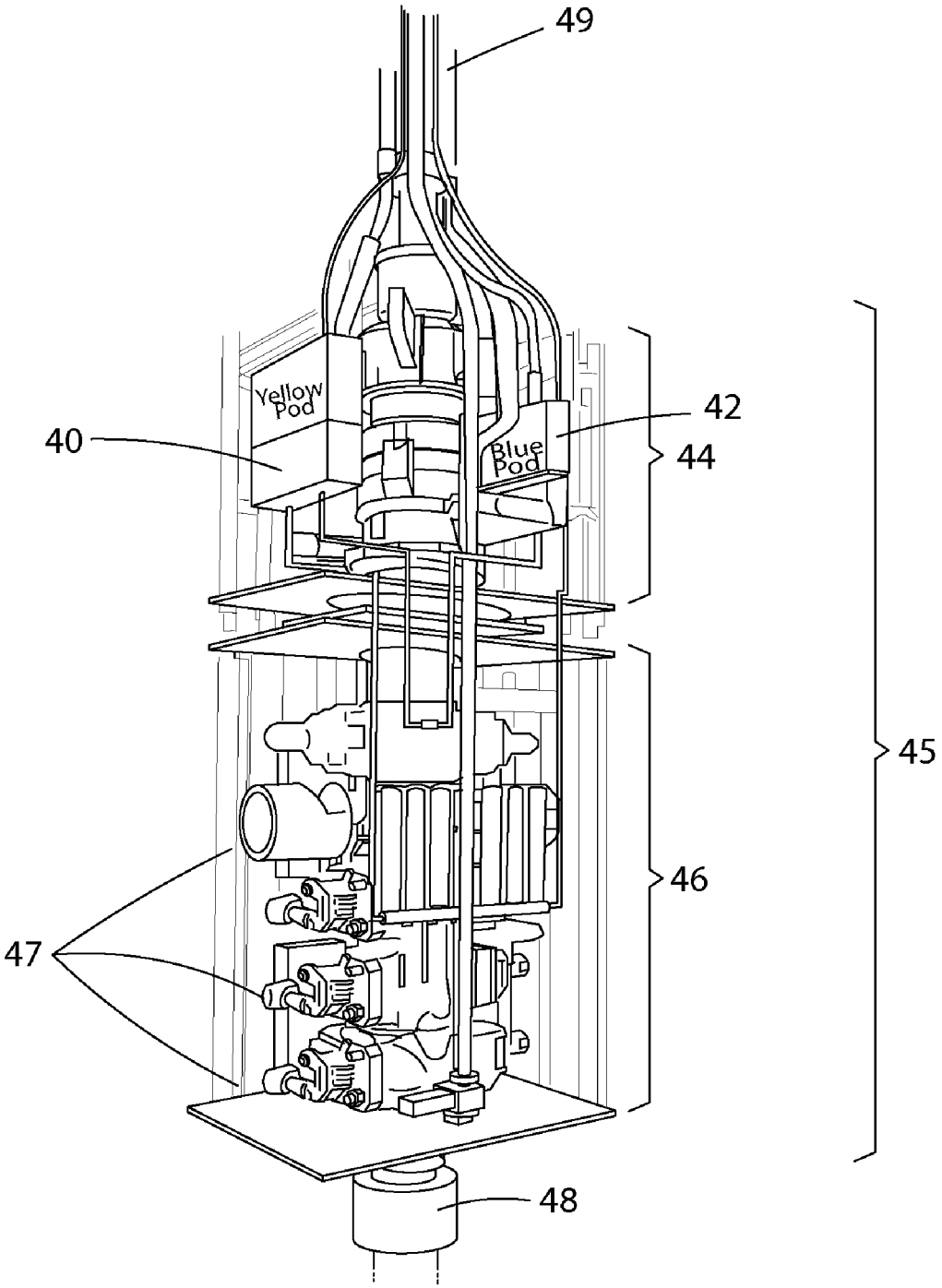
FIG. 3 is a BOP stack according to an exemplary embodiment.

The term "communicate" is used in the following description as meaning at least transmitting information from the BOP stack to the tree. In one embodiment, the term communicate also includes transmitting information from the tree to the BOP stack. The information may include electrical signals and/or hydraulic pressure. Most of the electrical signal are originally transmitted from the surface, i.e., from the rig or vessel, by the operator of the well. The electrical signals are directed to the MUX POD (see elements 40 and 42 in FIG. 3), a component of the BOP stack that is usually provided on the LMRP part 44 of the BOP stack 45. For redundancy purposes, two MUX PODs 40 and 42 are provided in the BOP stack 45. The BOP stack 45 also includes a lower BOP part 46 that includes various BOPs 47. The LRMP part 44 is detachably attached to the lower BOP part 46. The LRMP part 44 is attached to an end of a marine riser 49. The lower BOP part 46 is traditionally attached to the wellhead 48 of the well (not shown).

Figure 4:
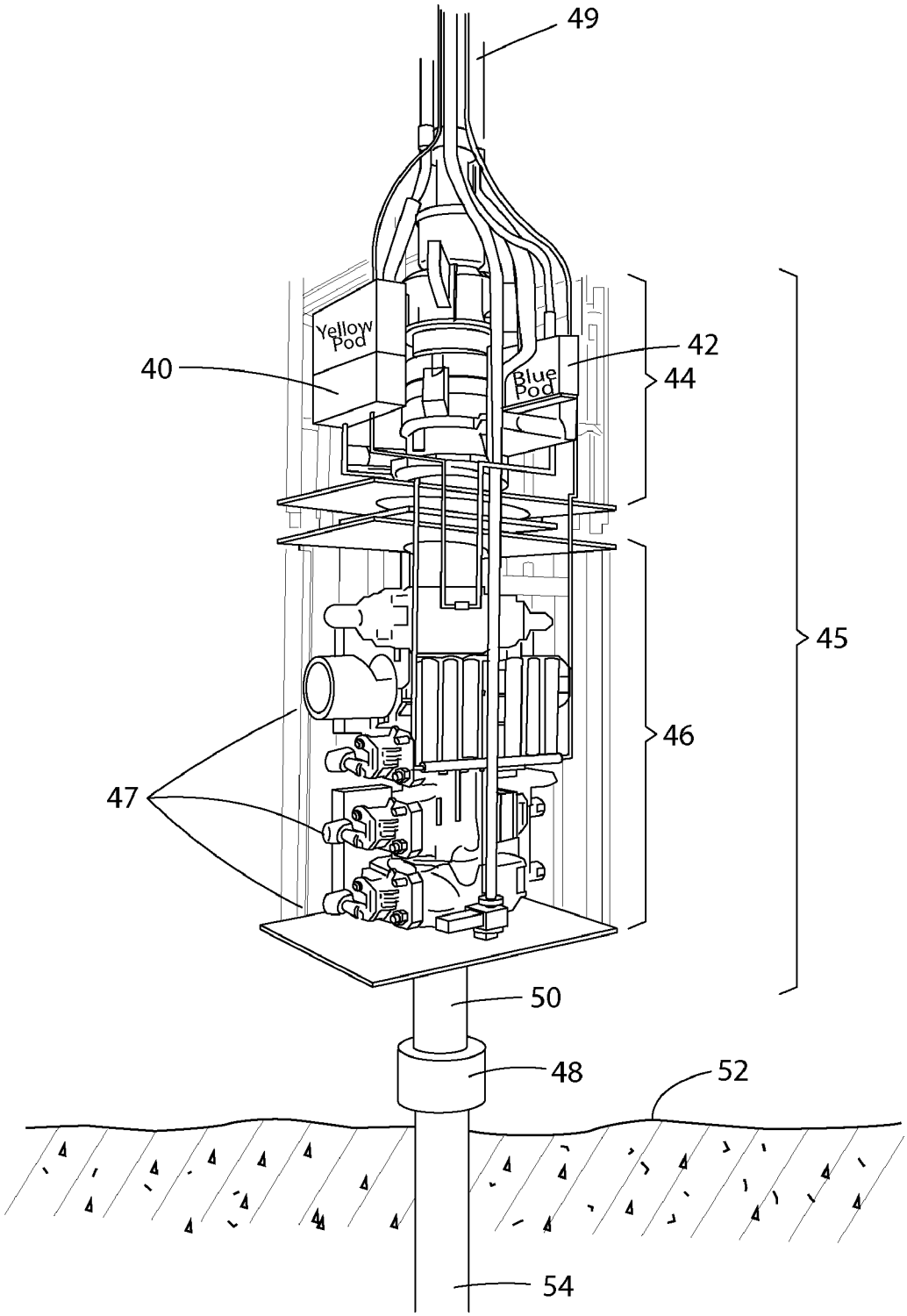
FIG. 4 is a BOP stack connected to a tree according to an exemplary embodiment.

According to an exemplary embodiment illustrated in FIG. 4, the BOP stack 45 is modified to provide the IWOC functionality instead of using a dedicated IWOC system for doing workover when a tree 50 is in place over the wellhead 48. FIG. 4 shows the ocean floor 52 and part of the well 54 extending into the ocean floor with one end and the other end being attached to the wellhead 48. The tree 50 (symbolically represented by a box but having a structure of its own depending on the manufacturer) is attached to the wellhead 48, which indicates that the drilling phase of the well has been finished and the well is now in the production phase.

However, as workover has to be done on the well, the BOP stack 45 is lowered in place and connected to the tree 50 as shown in FIG. 4. The BOP stack 45 can be an existing stack (e.g., drilling stack) that was retrofitted with the components to be discussed next or a dedicated workover BOP stack. Those skilled in the art would note that the operator does not need to rent or buy the IWOC system to achieve the desired workover as the existing BOPs (which usually are owned by the drilling contractor) can provide the same functionality to the tree if modified based on the following one or more embodiments.

The MUX POD 40 (for simplicity the other MUX POD 42 is not discussed here as it acts similar to MUX POD 40) is fluidly connected via one or more pipes to the lower BOP stack 46. These pipes transmit fluid under pressure from the LMRP part 44 to the lower BOP part 46 for executing various functions, e.g., closing or opening the BOPs 47 of the lower BOP part 46. In this regard, it is noted that a set of functions need to be provided to the lower BOP part 46 and this set of functions is achieved either by directly providing the fluid under pressure (hydraulic) to the lower BOP part 46 and/or by transmitting electrical signals from the MUX POD 40 to the lower BOP part 46 for activating these functions. Provisional Patent Application No. 61/329,883 and patent application Ser. Nos. 12/816,901, 12/816,912, and 12/816,923, all assigned to the assignee of the present application and incorporated herein in their entirety by reference, disclose the above noted functions and the communication (hydraulic and electrical) between the LMRP part 44 and the lower BOP part 46.

However, the existing MUX PODs may not be configured to handle and/or control the additional functions associated with the tree. For instance, the functions associated with the LMRP part and the lower BOP part may be different from the functions associated with the tree. Even if the functions are the same (e.g., closing a valve) the pressure or flow rate requirement for closing the valve on the BOP stack or the tree may be different. Thus, the existing MUX POD usually cannot be directly connected to the existing trees as these two elements were not designed to work together. Furthermore, the MUX POD capabilities may be limited for the following reasons. The MUX POD, which is located on the LMRP part 44, is configured to make a mechanical connection to a base plate located on the lower BOP part 46. This mechanical connection has a predetermined number of ports configured to connect corresponding ports from the LMRP part 44 with ports from the lower BOP part 46. In one application, the number of ports is 96. Depending on the manufacturer and the design of the BOP stack, this number can be larger or smaller.

Once all the ports of the MUX POD are used by the functions of the LMRP part 44 and the lower BOP part 46, traditionally, no other functions may be controlled by the MUX POD. Thus, there are situations in which no functions are available on the MUX POD for controlling other devices, e.g., the tree.

However, according to an exemplary embodiment illustrated in FIG. 5, the lower BOP part 46 may be fitted to have a pod extension module (PEM) 60 (to be discussed later) that is configured to communicate with the MUX POD 40 via, for example, a connection (not shown) between the LMRP 44 and the lower BOP part 46. Thus, a predetermined number of functions may be provided by the PEM 60. In the eventuality that all the functions of the MUX POD are already in use, one lower BOP part function of the MUX POD may be dedicated to the PEM 60 and that function may be restored on the lower BOP part from the PEM 60. However, as the PEM 60 has a predetermined number of functions, e.g., eight, the remaining functions may be used to provide the desired control to the tree 50. In another embodiment, multiple PEMs may be daisy-chained together to provide as many functions as required to operate the BOP and tree functions.

Figure 5:
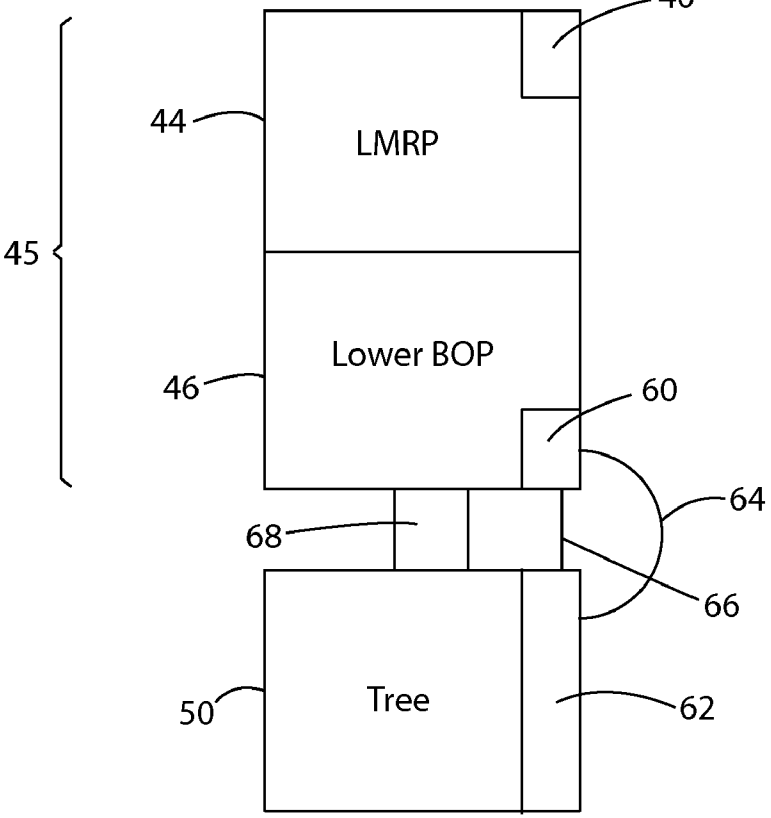
FIG. 5 is a BOP stack having a pod extension module that controls a tree via a hot stub according to an exemplary embodiment.

FIG. 5 shows that the PEM 60 may be connected to a control part 62 of the tree to provide both electrical (communication and/or power) and hydraulic functionality. One or more electrical cables 64 provide the electrical connection while one or more "hot stabs" 66 provide the hydraulic connectivity. In this regard, it is noted that it is possible to automatically engage the electrical and/or hydraulic connections 64 and 66 when the BOP stack 45 is lowered on the tree 50 (due to the weight of the BOP stack). Traditionally, a connection 68 between the BOP stack 45 and the tree 50 ensures that various electrical and hydraulic conduits connect to each other. The electrical and hydraulic connections 64 and 66 may be provided with male and female parts that sit on the BOP stack 45 and the tree 50 and automatically couple to each other when the BOP stack 45 is attached to the tree 50.

Figure 2:
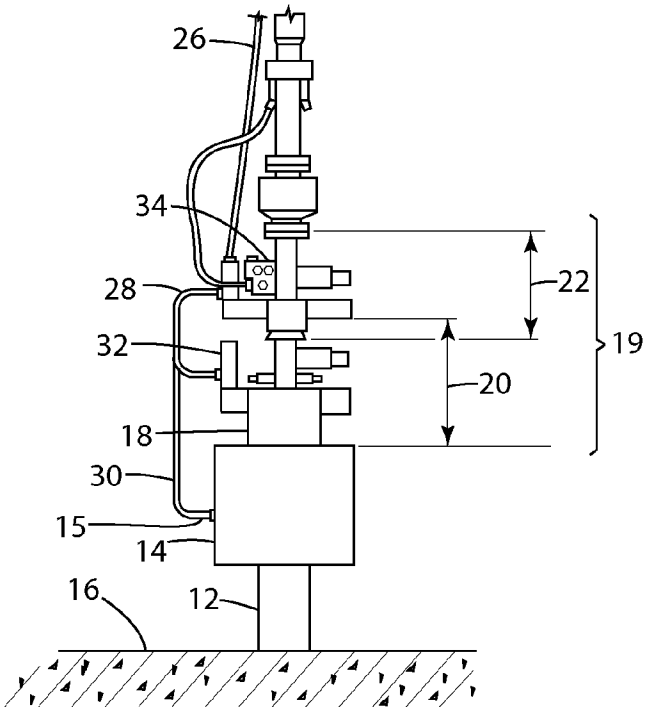
Figure 2 (Background Art)
FIG. 2 is a schematic diagram of a IWOC control system attached to a tree.
Figure 1:
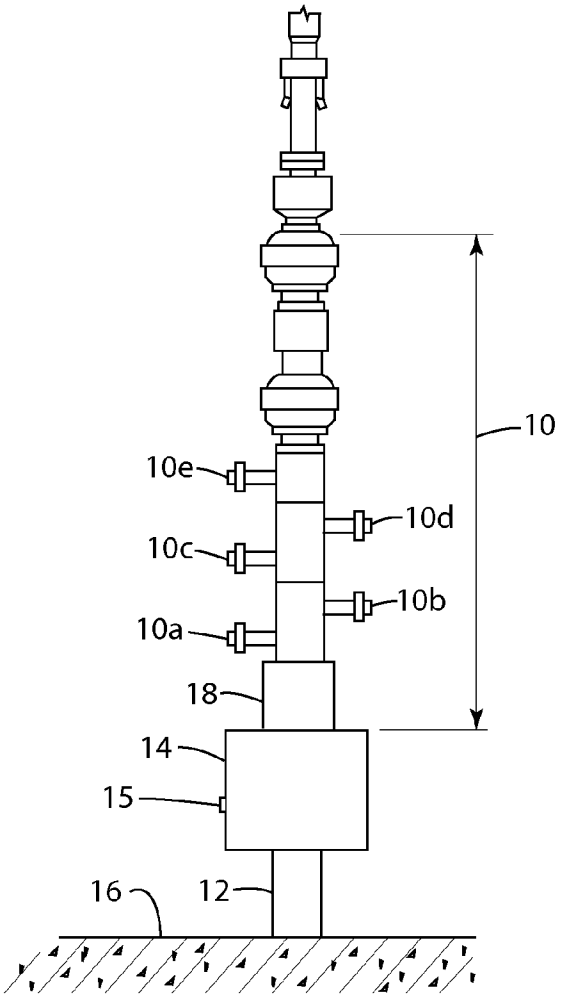
Figure 1 (Background Art)
FIG. 1 is a schematic diagram of a conventional BOP attached to a tree.

Thus, the PEM 60 that is attached to the lower BOP part 46 has to be configured to fit the existing functions managed by the control part 62 of the tree 50. Therefore, the PEM 60 may be installed on an existing lower BOP part 46 or on new BOP stacks. In one application, the PEM 60 may be installed on the LMRP part 44 to extend the functionality of the MUX POD 40. An advantage of this arrangement is that any lower BOP part may be fitted or retrofitted with the PEM 60 to provide the IWOC functionality and avoids the need of a dedicated IWOC system as shown in FIG. 2.

Figure 6:
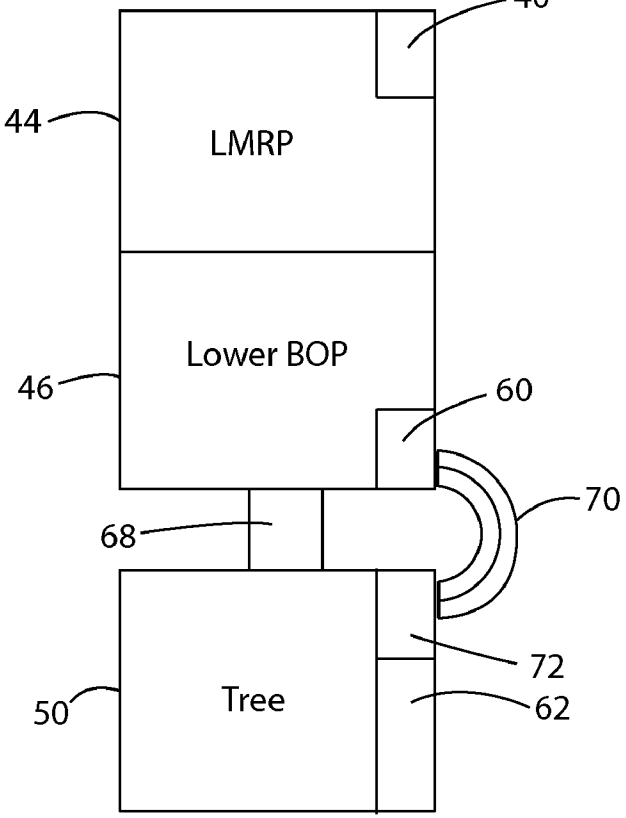
FIG. 6 is a BOP stack having a pod extension module that controls a tree via a discrete connection according to another exemplary embodiment.

According to another exemplary embodiment illustrated in FIG. 6, a discrete connection 70 may be provided between the PEM 60 and the tree control 62. The discrete connection 70 may include discrete hydraulic lines and/or electrical cables for transmitting, for example, readings from the tree to the PEM 60. In one application, a dedicated pod 72 may be needed to be connected to the tree control 62 for interfacing with the discrete connection 70. In one application, a remote operated vehicle (ROV) may be used to achieve the connection of the discrete connection 70 to the dedicated pod 72, after the lower BOP part has been landed on the tree. It is noted that the PEM 60 is shown in FIGS. 5 and 6 as being attached to the lower BOP part 46. However, this is not the only possibility envisioned by this application. In one application, the PEM 60 may be attached to the LMRP part 44. In a similar way, the MUX pod 40 may be provided on the lower BOP part 46 instead of the LMRP part 44.

Figure 7:
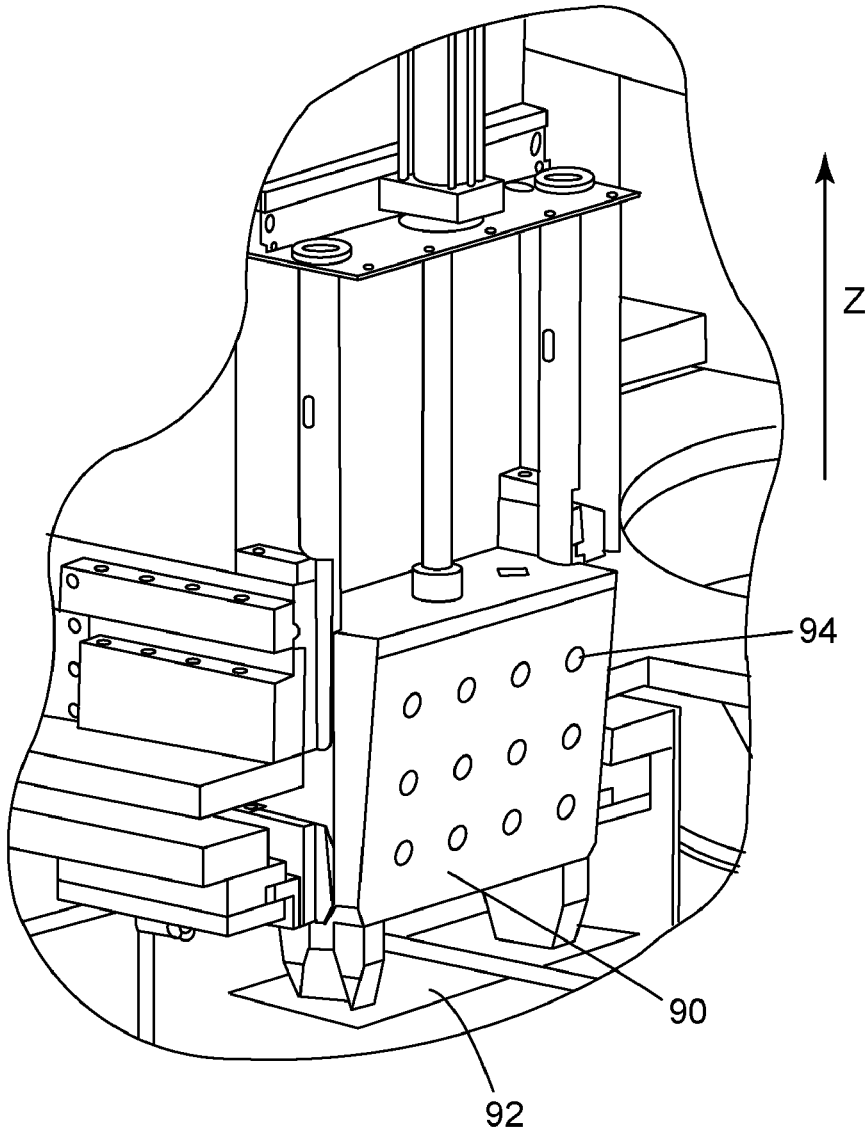
FIG. 7 is a pod wedge that connects a BOP stack to a tree according to an exemplary embodiment.
Figure 8:
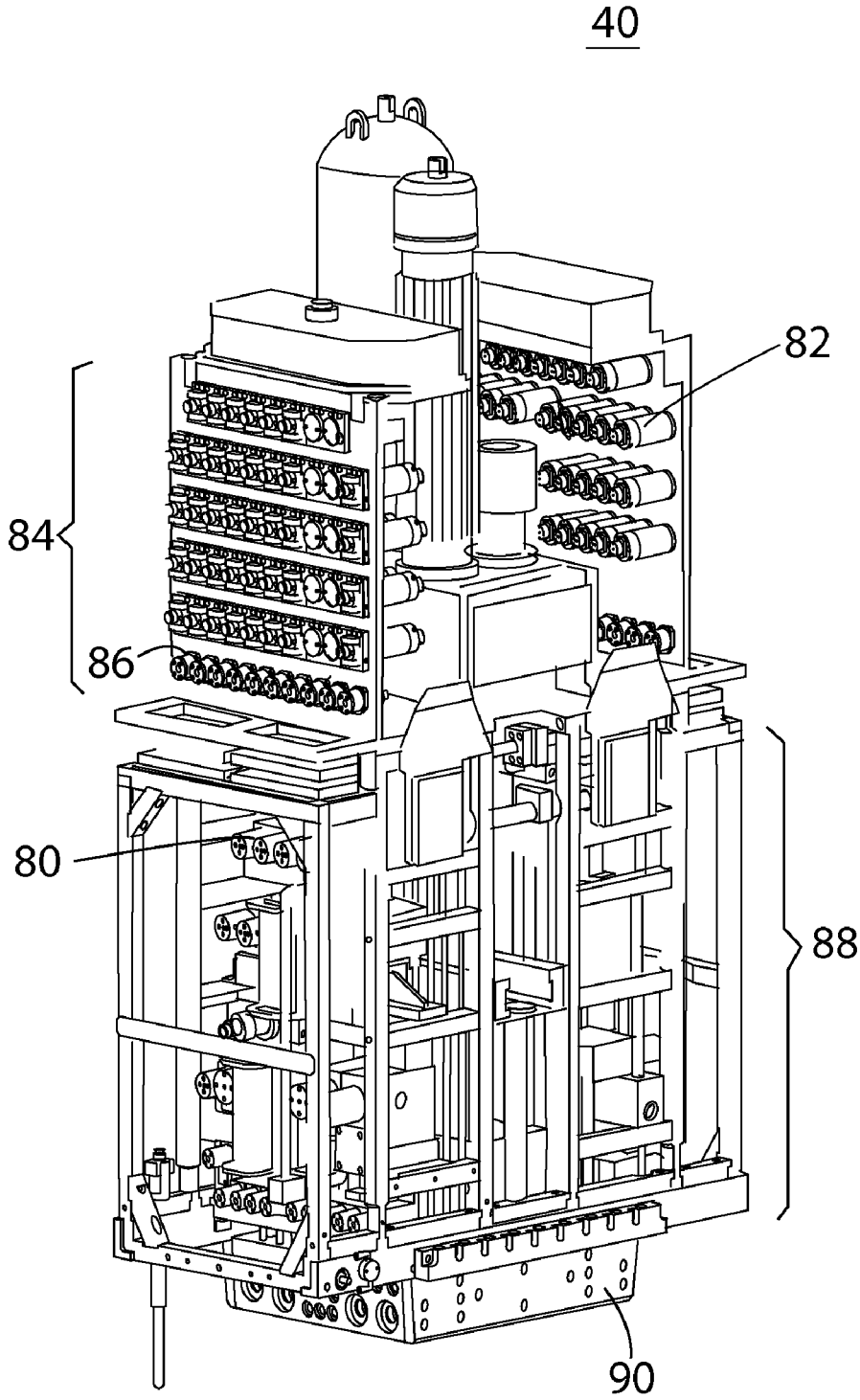
FIG. 8 is a MUX pod that controls a tree according to an exemplary embodiment.

According to another exemplary embodiment, the connection between the lower BOP part 46 and the control part 62 of the tree 50 may be achieved using a pod wedge connection as illustrated in FIG. 7. FIG. 7 shows the pod wedge 90 being configured to move up and down along axis Z to connect the lower BOP part 46 with a receiving base 92 attached to the tree 50. Holes 94 provided in the pod wedge 90 are configured to transmit the fluid under pressure to the tree 50 when the pod wedge 90 is engaged with the receiving base 92. Corresponding holes (not shown) are formed in the receiving base of the tree 50 for receiving the fluid under pressure. Optionally, a wet-mateable electrical connection may be provided on the pod wedge 90 and the receiving base 92 for bridging electrical communications. The pod wedge 90 may be hydraulically activated to move along the Z axis.

More details are now provided about the MUX pod 40 and the PEM 60. The MUX pod 40 may be fixedly attached to a frame (not shown) of the LMRP part 44 and may include hydraulically activated valves 80 (called in the art sub plate mounted (SPM) valves) and solenoid valves 82 that are fluidly connected to the hydraulically activated valves 80. The solenoid valves 82 are provided in an electronic section 84 and are designed to be actuated by sending an electrical signal from an electronic control board (not shown). Each solenoid valve 82 is configured to activate a corresponding hydraulically activated valve 80. The MUX pod 40 may include pressure sensors 86 also mounted in the electronic section 84. The hydraulically activated valves 80 are provided in a hydraulic section 88.

Figure 9:
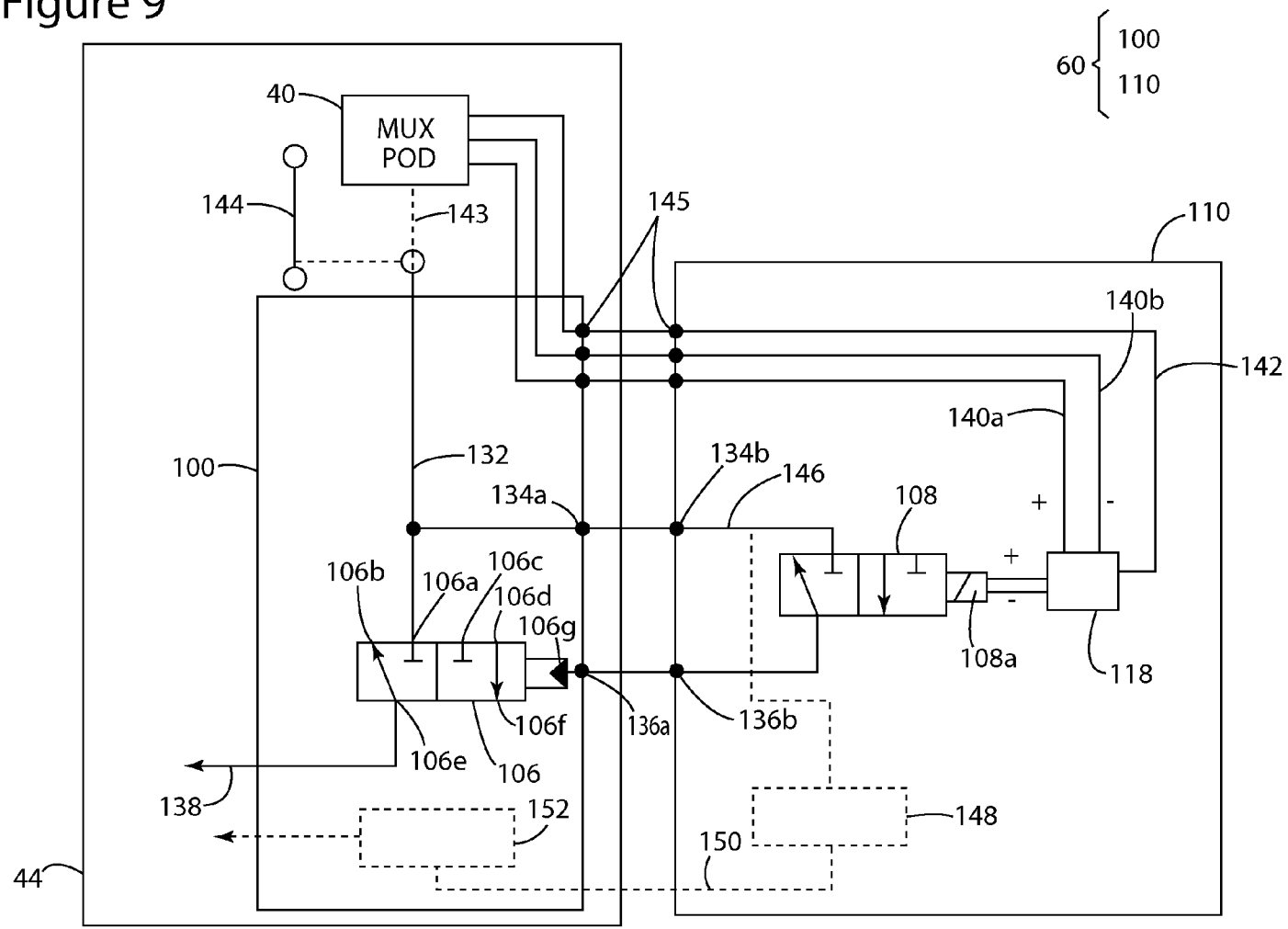
FIG. 9 is a pod extension module for controlling a tree according to an exemplary embodiment.

According to an exemplary embodiment illustrated in FIG. 9, the PEM 60 may include a fixed part 100 and a removable section 110. However, in one application both parts 100 and 110 are fixed. FIG. 9 shows an implementation of the fixed part 100 and the removable section 110 on the LMRP part 44. That means that the MUX pod 40 and the fixed part 100 are fixed to the LMRP part 44. However, the PEM 60 may be fixed to the lower BOP part 46. The removable section 110 is removably attached to the fixed part 100. The fixed part 100 includes one or more SPM valves 106 (only one is shown for simplicity). The high pressure fluid is received via conduit 132 to a first input 106*a* of the SPM valve 106. In this exemplary embodiment, SPM valve 106 has inputs and outputs 106*a* to 106*f*. SPM valves 106 with other configurations may be used.

SPM valve 106 is activated by receiving the fluid under high pressure at gate 106*g*. This fluid is controlled by pilot valve 108 provided in the removable section 110. Pilot valve 108 may have a similar structure as the SPM valve 106 except that an electrical gate 108*a* is used to activate the valve. The pilot valve 108 may receive the fluid under pressure from the same conduit 132 used by the SPM valve 106 or another hydraulic source. Thus, connections 134*a* and 134*b* are implemented on the fixed part 100 and the removable section 110, respectively, for bringing the fluid under pressure to the pilot valve 108. Similar or different connections 136*a* and 136*b* are used for providing the fluid under pressure from the pilot valve 108 to the SPM valve 106 when a corresponding electrical signal is received at gate 108*a*. Thus, when the pilot valve 108 is activated, the fluid from conduit 132 flows via the pilot valve 108 to the gate 106*g* to activate the SPM valve 106. After the SPM valve gate 106*g* is activated, fluid from conduit 132 flows via SPM valve 106 to outlet 138 and to the desired function to be controlled.

It is noted that the fluid under pressure entering conduit 132 may be provided either directly from MUX pod 40 along a conduit or from another source, e.g., hot line 144. The fluid may be regulated internally at the MUX pod 40. The hot line 144 may be connected to accumulators or to a conduit that communicates with the ship (not shown) manning the operation of the LMRP.

Similar to the fixed part 100, the removable section 110 may include more than one pilot valve 108. The removable section 110 also includes an electronic part 118 that is electrically connected to the pilot valves for transmitting various commands to them. The electronic part 118 may be connected to power supply lines 140*a* and 140*b* that are connected to the MUX pod 40 via the fixed part 100. In addition, the electronic part 118 may include one or more lines 142 (e.g., RS 485 cables) for transmitting various commands from the MUX pod 40 to the corresponding solenoid valves 108 via the fixed part 100. Corresponding wet-mateable electric connectors 145 (e.g., connectors configured to mate/de-mate subsea) may be mounted on the fixed part 100 and the removable section 110 for transmitting the electric power and the commands from one module to the other. Multiple fixed parts 100 and corresponding removable sections 110 may be used on the same subsea structure.

If more than one pilot valve 108 is provided on the removable section 110, the same supply line 146 may be used to supply the fluid under pressure to each of the pilot valve 108. However, each pilot valve 148 would have its own output 150 fluidly communicating with a corresponding SPM valve 152. In other words, for a control module (fixed part 100 and removable section 110) having a predetermined number of functions n (e.g., 8), there are n+1 inlet hydraulic ports, one corresponding to conduit 146 and the others corresponding to outlet ports 150. In one application, the conduit 146 may be connected to another source of fluid under pressure instead of the MUX pod 40 or conduit 144. The removable section 110 may include other elements than those shown in the figures. For example, the removable section 110 may include one or more filtration devices, pressure sensing devices, etc. Similarly, the fixed part may include other devices, e.g., pressure regulators.

If the fixed part 100 and the removable section 110 are disposed on the BOP stack, then the power supply and the communication supply may stay the same, e.g., from MUX POD 40, but the hydraulic supply may provided by a hot line that provides the fluid under high pressure for operating the BOPs of the BOP stack. In one application, the removable section 110 may be fixedly attached to the fixed part 100 so that the PEM 60 is one single component.

Figure 10:
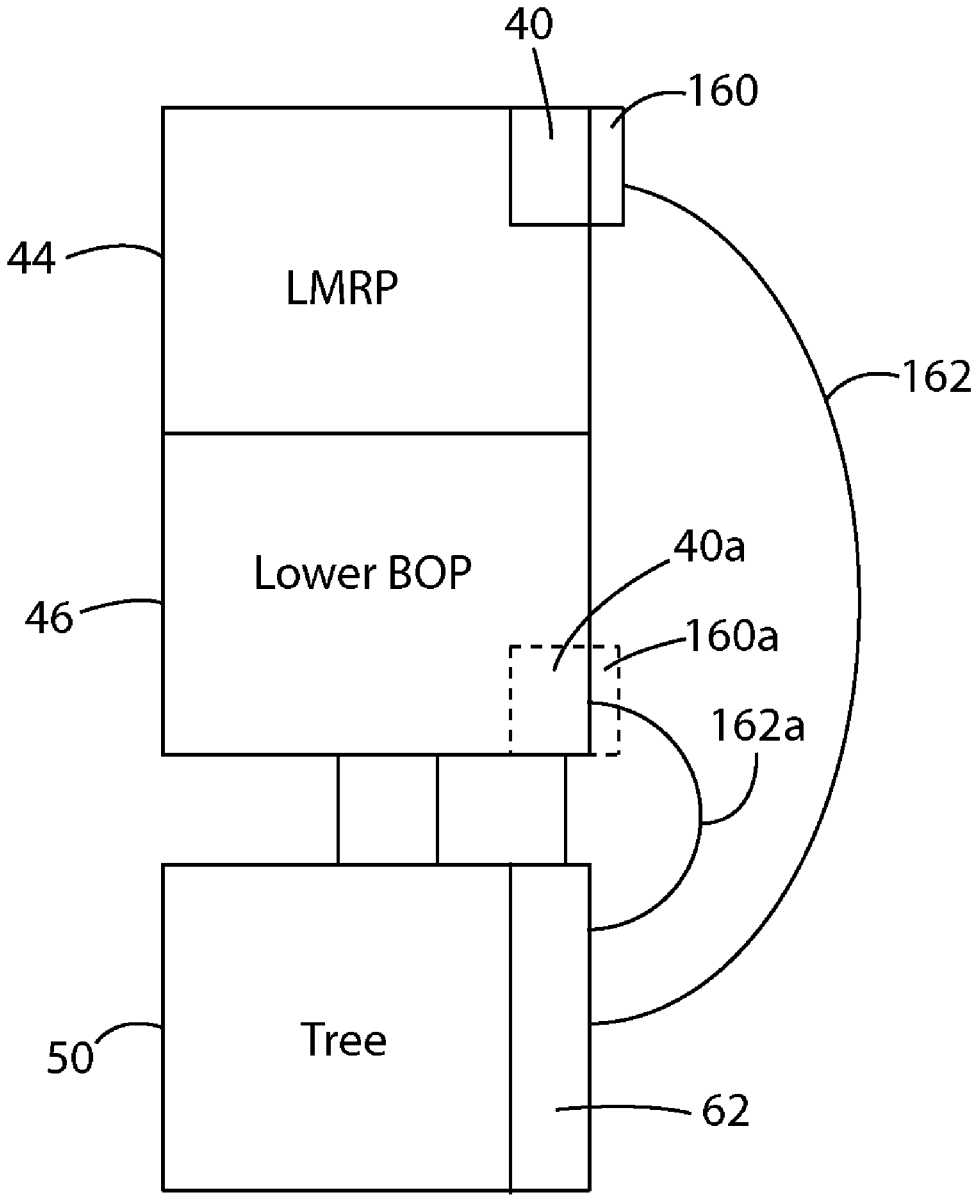
FIG. 10 is a flow chart illustrating a method for controlling a tree according to an exemplary embodiment.

According to an exemplary embodiment illustrated in FIG. 10, the MUX pod 40 may have an interface 160 that is configured to directly communicate with the control part 62 of the tree 50. The interface 160 may be retrofitted to an existing MUX pod 40 or may be manufactured as an integral part of the MUX pod 40. The interface 160 is connected via a communication port 162 to the control part 62 of the tree 50. The communication port 162 may be configured to communicate electrical signals and/or hydraulic signals between the MUX pod 40 and the tree 50. In another application, a MUX pod 40*a* is provided on the lower BOP part 46 instead of the LMRP part 44. For this application, an interface 160*a* and a communication port 162*a*, similar to the interface 160 and the communication port 162 are provided to connect the MUX pod 40*a* to the tree 50. All other features discussed for the previous embodiments equally apply to this embodiment.

Figure 11:
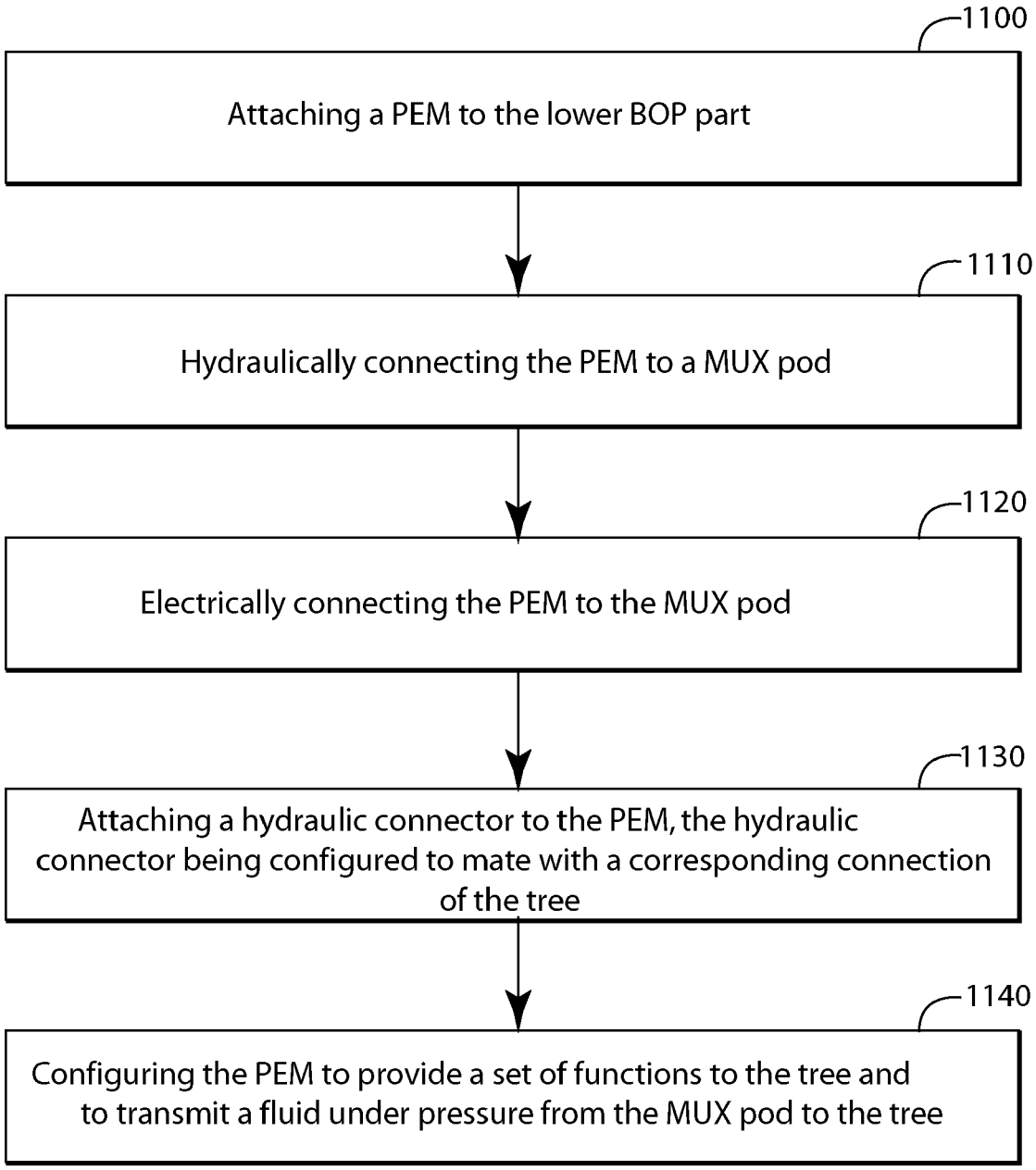
FIG. 11 illustrates an exemplary embodiment of a method for providing tree control via a lower blowout preventer (BOP) part.

According to an exemplary embodiment illustrated in FIG. 11, there is a method for providing tree control via a lower blowout preventer (BOP) part, where the lower BOP part is connected to a lower marine riser package (LMRP) part to form a BOP stack that is attached undersea to the tree. The method includes a step 1100 of attaching a PEM to the lower BOP part; a step 1110 of hydraulically connecting the PEM to a MUX pod that is attached to the LMRP part; a step 1120 of electrically connecting the PEM to the MUX pod; a step 1130 of attaching a hydraulic connector to the PEM, the hydraulic connector being configured to mate with a corresponding connection of the tree; and a step 1140 of configuring the PEM to provide a set of functions to the tree and to transmit a fluid under pressure from the MUX pod to the tree.

The disclosed exemplary embodiments provide a system and a method for providing IWOC functionality to a tree via a BOP stack. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. An apparatus for controlling pressure while drilling subsea wells and while performing workover operations on a production well, comprising:

a blowout preventer (BOP stack having a lower marine riser package (LMRP) part configured to be attached to an end of a marine riser suspended from a drilling vessel;

a lower BOP part configured to be detachably attached to the LMRP part and to land on a subsea production tree;

at least one multiplex (MUX) pod attached to the BOP stack, the MUX pod having solenoid actuated BOP pilot valves hydraulically connected to BOP hydraulic valves, which in turn are connected to a hydraulic pressure supply and to various components of the BOP stack for controlling pressure of a well while drilling;

an umbilical connected to the MUX pod and adapted to be connected to the drilling vessel for supplying electrical control signals to the BOP pilot for performing selected functions with the components of the BOP stack;

a pod extension module having solenoid actuated pod extension pilot valves hydraulically connected to pod extension module hydraulic valves which in turn are connected to the hydraulic pressure supply;

an electrical line extending fro MUX pod to the pod extension module pilot valves for supplying electrical control signals via the umbilical from the drilling vessel through the MUX pod to the pod extension module pilot valves; and a hydraulic connector connected to the pod extension module hydraulic valve and adapted to be connected to the tree for supplying hydraulic fluid pressure from the pod extension module hydraulic valves to various components of the tree while performing workover operations on the tree.

2. The apparatus of claim 1, wherein the pod extension module is mounted to the BOP stack.

3. The apparatus of claim 1, wherein the hydraulic connector comprises a hot stab connection configured to automatically connect the pod extension module valves to the tree when the lower BOP part contacts the tree.

4. The apparatus of claim 1, further comprising:

a wet-mateable electrical connection between the pod extension module and a control part of the tree, wherein the wet-mateable electrical connection transfers electrical signals between the pod extension module and the control part of the tree.

5. The apparatus of claim 4, wherein the wet-mateable electrical connection is configured to be connected to the control part of the tree by a remote operated vehicle.

6. The apparatus of claim, wherein:

the wet-mateable electrical connection is configured to be connected to the control part of the tree when the lower BOP part contacts the tree.

7. The apparatus of claim 1, wherein the hydraulic connector is configured to be connected to the control part of the tree by a remote operated vehicle.

8. The BOP stack of claim 1, further comprising:

a pod wedge between the pod extension module and a control part of the tree, wherein the pod wedge is configured to directly transfer the hydraulic fluid pressure from the pod extension module hydraulic valves to the tree.

9. The apparatus of claim 8, wherein the pod wedge is movably attached to the lower BOP part and configured to move along a predetermined axis to connect and disconnect from the tree.

10. The apparatus of claim 1, wherein the MUX pod is configured to communicate with a control part in the tree only through the pod extension module.

11. A system for controlling a blowout preventer (BOP) stack during drilling of the subsea well and a subsea tree during workover operations, the BOP stack including a lower BOP part and a lower marine riser package (LMRP) part, the system comprising:

at least one multiplex (MUX) pod configured to be attached to the BOP stack to receive electrical signals via an umbilical from a drilling vessel during drilling and workover operations, the MUX pod having solenoid actuated BOP pilot valves hydraulically connected to the BOP hydraulic valves to control the BOP hydraulic valves to provide hydraulic fluid pressure from a hydraulic pressure supply to a first set of components of the LMRP part, and a second set of components of the lower BOP part;

a pod extension module configured to be attached to the BOP stack, the pod extension module having solenoid actuated pod extension module pilot valves hydraulically connected to pod extension module hydraulic valves the pod extension module pilot valves being electrically connected to the MUX pod to receive electrical signals sent from the drilling vessel to the MUX pod via the umbilical during workover operations; and a hydraulic connector extending from the pod extension module hydraulic valves and configured to be attached to the tree to communicate hydraulic fluid pressure from the pod extension module hydraulic valves to components of the tree during workover operations.

12. The system of claim 11, wherein the hydraulic connector comprises:

a hot stab connection for connecting between the pod extension module and a control part of the tree, wherein the hot stab connection is configured to automatically connect the pod extension module to the tree when the lower BOP part contacts the tree.

13. The system of claim 12, further comprising:

a wet-mateable electrical connection for connecting between the pod extension module and the control part of the tree, wherein the wet-mateable electrical connection tranfers electrical signals between the pod extension module and the control part of the tree.

14. The system of claim 13, wherein the wet-mateable electrical connection is configured to be connected to the control part of the tree by a remote operated vehicle.

15. The system of claim 13, wherein the wet-mateable electrical connection is configured to be connected to the control part of the tree automatically when the lower BOP part contacts the tree.

16. The system of claim 12, wherein the hydraulic connector comprises:

a pod wedge between the pod extension module and a control part of the tree, wherein the pod wedge is configured to directly transfer the hydraulic fluid pressure from the pod extension module hydraulic valves to the tree, and the pod wedge is movably attached to the lower BOP part and configured to move along a predetermined axis to connect and disconnect from the tree.

17. A method for providing drilling and tree control via a lower blowout preventer (BOP) part, wherein the lower BOP part is connected to a lower marine riser package (LMRP) part to form a BOP stack that is suspended from a drilling vessel, the method comprising:

providing the LMRP with a multiplex (MUX) pod having solenoid actuated pilot valves connected to BOP hydraulic valves that in turn are connected to a hydraulic pressure supply, and connecting the BOP hydraulic valves to various BOP components of the BOP stack:

connecting a umbilical from the drilling vessel to the MUX pod;

providing a pod extension module having solenoid actuated pilot valves connected to hydraulic valves that are connected to the hydraulic pressure supply:

electrically connecting the pod extension module to the MUX pod;

providing electrical signals to the MUX pod via the umbilical to cause the pilot valves of the MUX pod to supply hydraulic signals to operate the BOP hydraulic valves, which deliver hydraulic fluid pressure from the hydraulic pressure supply to perform selected functions with the components of the BOP stack while drilling:

landing the BOP stack on a subsea production tree having hydraulically actuated tree components and a receptacle connected to the tree components via hydraulic fluid passages;

attaching a hydraulic connector from the pod extension module to the receptacle of the tree, and providing electrical signals via the umbilical to the MUX pod and directing the electrical signals from the MUX pod to the pod extension module, causing the pilot valves of the pod extension module to provide hydraulic signals to operate the hydraulic valves of the pod extension module, which deliver hydraulic fluid pressure from the hydraulic fluid pressure supply to the tree components to perform selected functions with the tree components.

18. The method of claim 17, wherein the hydraulic valves of the pod module are connected to the hydraulic pressure supply via the MUX pod.

19. The method of claim 18, further comprising:

using a remote operated vehicle to connect the hydraulic connector of the pod extension module to the receptacle of the tree.

20. The method of claim 18, further comprising:

using a weight of the BOP stack to connect the hydraulic connector of the pod extension module to the receptacle of the tree.

21. An apparatus for controlling pressure during subsea drilling operations and workover operations, comprising:

a blowout preventer (BOP) stack having an upper end for connection to a marine riser supported by a drilling vessel and a lower end for connection to a subsea wellhead during drilling operations and to a production tree during workover operations, the BOP stack having a plurality of rams for closing around a pipe string extending through the marine riser into the wellhead;

a multiplex (MUX) pod attached to the BOP stack, the MUX pod having solenoid actuated BOP pilot valves and BOP hydraulic valves, which are connected to a hydraulic pressure supply and to the rams, the MUX pod adapted to be connected to an umbilical extending downward from the vessel for supplying electrical control signals to the BOP pilot valves;

a pod extension module attached to the BOP stack, the pod extension module having solenoid actuated pod extension module pilot valves and pod extension module hydraulic valves that are connected to the hydraulic pressure supply;

a hydraulic connector extending from the pod extension module hydraulic valves for connection to the tree during workover operations; and an electrical line extending from the MUX pod to the pod extension module for providing to the pod extension module pilot valves electrical signals sent from the drilling vessel via the umbilical to actuate components of the tree.

* * * * *